US005301561A

United States Patent [19]

Karlsson

[11] Patent Number: 5,301,561

[45] Date of Patent: Apr. 12, 1994

[54] METHOD AND APPARATUS FOR TAKING A FLUID SAMPLE

[75] Inventor: Haraldur Karlsson, Kingwood, Tex.

[73] Assignee: Energy Ventures, Inc., Houston, Tex.

[21] Appl. No.: 706,212

[22] Filed: May 28, 1991

[51] Int. Cl.[5] ..... E21B 49/08

[52] U.S. Cl. ..... 73/864.74; 175/21; 175/59

[58] Field of Search ..... 73/155, 864.73, 864.74; 175/21, 22, 23, 59; 166/169, 264

[56] References Cited

U.S. PATENT DOCUMENTS

| | | | |
|---|---|---|---|
| 576,953 | 2/1897 | Davis | 175/23 |
| 1,784,886 | 12/1930 | Baker | 175/245 |
| 2,141,261 | 12/1938 | Clark | 73/864.74 |
| 2,141,261 | 12/1938 | Clark | 73/864.61 |
| 2,170,716 | 8/1939 | Higgins | 175/58 |
| 2,382,992 | 8/1945 | Harris | 175/20 |
| 2,740,477 | 4/1956 | Monaghan | 166/63 |
| 3,064,742 | 11/1962 | Bridwell | 175/226 |
| 3,139,147 | 6/1964 | Hays et al. | 175/233 |
| 3,146,837 | 9/1964 | Bridwell | 175/59 |
| 3,163,241 | 12/1964 | Daigle et al. | 175/237 |
| 3,438,452 | 4/1969 | Bernard et al. | 175/6 |
| 3,794,127 | 2/1974 | Davis | 175/58 |
| 4,081,040 | 3/1978 | Henson | 175/58 |
| 4,310,057 | 1/1982 | Brame | 73/864.74 X |
| 4,317,490 | 3/1982 | Milberger et al. | 175/20 |
| 4,335,622 | 6/1982 | Bartz | 73/864.74 |
| 4,350,051 | 9/1982 | Thompson | 73/864.74 |
| 4,356,872 | 11/1982 | Hyland | 175/58 |
| 4,518,050 | 5/1985 | Sollie | 175/250 |
| 4,669,554 | 6/1987 | Cordry | 175/59 |
| 4,804,050 | 2/1989 | Kerfoot | 175/20 |
| 4,807,707 | 2/1989 | Handley et al. | 73/864.74 |

OTHER PUBLICATIONS

Whitebay: SPE #15385 "Improved Coring and Core--Handling Procedures for the Unconsolidated Sands of the Green Canyon Area, Gulf of Mexico", 1985.

Tibbitts & Radford: SPE #14297 "New Technology in Tools for Recovery of Representative Cores From Uncemented Sand Formations", 1985.

*Primary Examiner*—Hezron E. Williams
*Assistant Examiner*—Michael Brock
*Attorney, Agent, or Firm*—Fulbright & Jaworski

[57] ABSTRACT

A fluid sampling device particularly suited for downhole applications is disclosed. The device has a tubular housing with a retractable sample tube nested within. The housing and sample tube have generally pointed leading edges to facilitate embedment into the formation to a sufficient depth to isolate the fluid sample to be obtained from well fluids. Having embedded the apparatus a sufficient depth, a downward force is applied to the sample tube, severing its prior restraint to the housing and extending the sample tube into the formation. Openings in the sample tube allow the fluid to come through it, whereupon it is conducted to the surface. Removal of the downward forces applied to the sample tube allows a biasing mechanism to act on the sample tube to retract it into the housing prior to the removal of the housing from the formation.

10 Claims, 1 Drawing Sheet

METHOD AND APPARATUS FOR TAKING A FLUID SAMPLE

FIELD OF THE INVENTION

This invention relates to tools that are useful for sampling formation gases, particularly downhole.

BACKGROUND OF THE INVENTION

Sampling or coring devices have been known in the past. Typical of devices for obtaining solid core samples are U.S. Pat. Nos. 4,317,490; 3,163,241; 4,356,872; 3,146,837; 1,784,886; 2,170,716; 3,064,742; 3,438,452; 4,081,040; 3,794,127; and 4,518,050. Specific techniques for coring and obtaining formation soil samples were also discussed in Society of Petroleum Engineers (SPE) paper 15385 by Whitebay, called "Improved Coring and Core-Handling Procedures for the Unconsolidated Sands of the Green Canyon Area, Gulf of Mexico," and SPE paper 14297 by Tibbitts and Radford, entitled "New Technology in Tools for Recovery of Representative Cores from Uncemented Sand Formations."

A variety of formation fluid sampling tools have been used in the past. Some of these tools are adaptable to also sample formation liquids. These tools include U.S. Pat. Nos. 2,382,992; 4,669,554; 4,310,057; 2,141,261; 4,350,051; 4,335,622; 4,804,050; 2,740,477; 3,139,147; and 4,807,707.

The apparatus of the present invention provides a simply constructed fluid sampling tool which is designed to accommodate fluid sampling from within the formation at a depth sufficient to preclude contamination of the fluid sample obtained with formation liquids.

The simple construction of the apparatus of the present invention facilitates its objective of obtaining undisturbed fluid samples. The apparatus does not require auxiliary devices to be inserted ahead of it into the formation prior to obtaining the fluid samples. The apparatus is also equipped with means to facilitate its rapid extraction.

SUMMARY OF THE INVENTION

A fluid sampling device particularly suited for downhole applications is disclosed. The device has a tubular housing with a retractable sample tube nested within. The housing and sample tube have generally pointed leading edges to facilitate embedment into the formation to a sufficient depth to isolate the fluid sample to be obtained from well fluids. Having embedded the apparatus a sufficient depth, a downward force is applied to the sample tube, severing its prior restraint to the housing and extending the sample tube into the formation. Openings in the sample tube allow the fluid to come through it, whereupon it is conducted to the surface. Removal of the downward forces applied to the sample tube allows a biasing mechanism to act on the sample tube to retract it into the housing prior to the removal of the housing from the formation.

DETAILED DESCRIPTION OF THE PREFERRED EMBODIMENT

Figure 1:
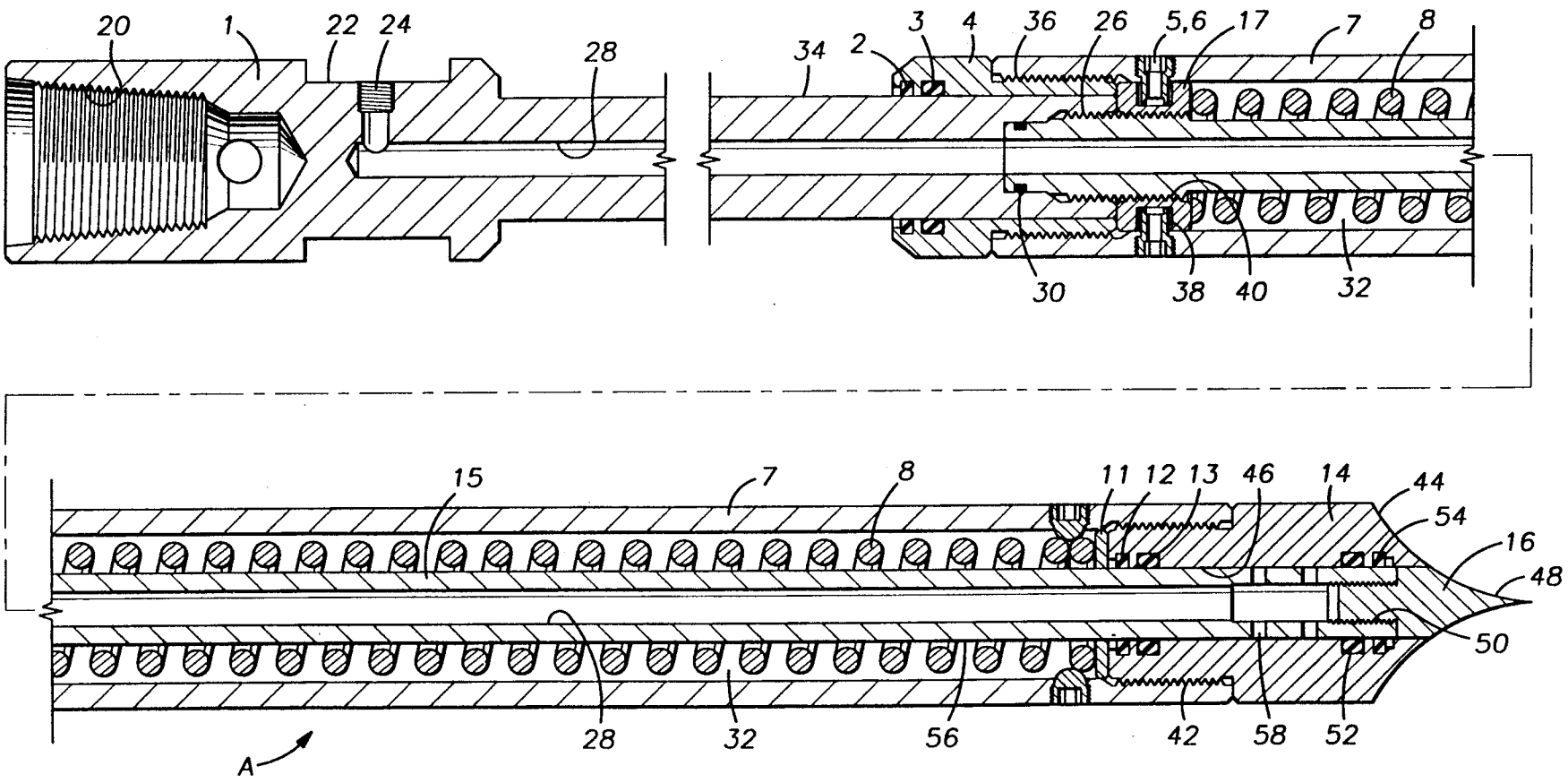
FIG. 1 is a sectional view illustrating the details of the invention.

The apparatus A has a mandrel 1 which has a thread 20 at its upper end. A length of tubing (not shown) can be connected to threaded connection 20 to allow lowering of the apparatus A into the wellbore adjacent the formation whose fluid is to be sampled. Adjacent thread 20 is boss 22, to which an appropriate fitting (not shown) is connected to allow the establishment of fluid communication to the surface from passage 24. A suitable fitting connected to boss 22 is also connected to tubing (not shown) which is connected to the tubing string so that fluid samples obtained through passage 24 can be conducted to the surface. Alternative means of conducting the fluid to the surface are also within the purview of the invention. For example, the fluid collected into passage 24 can be conducted straight up through the tubing string rather than alongside and outside of the tubing string through a separate tubing run. Alternatively, the apparatus A of the present invention can be suspended in the area adjacent the formation whose fluids are to be sampled on a slickline or wireline and dropped a fair distance for embedment in the formation and subsequent sampling, as will be described. However, the preferred embodiment is as shown in FIG. 1, where a tubing string is used to lower the apparatus A adjacent the formation and is also used to apply downward forces on mandrel 1 to initiate operation.

Mandrel 1 is secured to sample tube 15 by thread connection 26. A passage 28 extends through sample tube 15 and into mandrel 1 where lateral passage 24 intersects it. A seal 30 prevents leakage at the connection between sample tube 15 and mandrel 1 out of passage 28.

Mandrel 1 also extends into barrel 7, creating an annular space 32 within which is disposed spring 8. Spring 8 bears on thrust washer 11 at one end and shear nut 17 at the other end. At the upper end of barrel 7 is seal cap 4, which has attached to it wiper 2 and seal 3, which ride in contact with surface 34 on mandrel 1. Wiper 2 wipes off any accumulated well fluids on surface 34 prior to its engaging seal 3 to enhance the operation of seal 3. Seal cap 4 is connected to barrel 7 by threaded connection 36. Mandrel 1 is free to translate with respect to seal cap 4 and barrel 7 when shear screws 5 are sheared. Shear screws 5 are peripherally mounted through barrel 7 and extend into a cavity 38 which is disposed in shear nut 17. Shear nut 17 is threadedly connected to sample tube 15 at thread 40. As shown in FIG. 1, the shear screws 5 can be disposed within a pipe plug 6. However, alternative ways of disposing the shear screws may be used without departing from the spirit of the invention.

As previously slated, the spring 8 bears against shear nut 17.

At the lower end of barrel 7 is bottom sub 14, which is connected to barrel 7 by thread 42. Sub 14 has a tapered leading end 44 and a central bore 46 to accommodate sample tube 15. At the leading end of sample tube 15 is sample tube point 16, which has a generally tapered profile 48 at its leading edge, disposed to extend the tapered profile 44 of bottom sub 14. Sample tube point 16 is connected to sample tube 15 at thread 50. While a threaded connection 50 is recited, different types of connections between the sample tube point 16 and the sample tube 15 can be employed without departing from the spirit of the invention. A seal 52 seals between bottom sub 14 and sample tube 15. A wiper 54 precedes seal 52 to wipe the outer surface 56 of sample tube 15 prior to its making contact with seal 52.

Passage 28 extends through sample tube 15 until it reaches lateral passages 58. Passages 58 are shown in FIG. 1 as disposed in two parallel rows; however, fewer or greater numbers of rows of lateral passages can be used without departing from the spirit of the invention.

It can be seen that the apparatus A of the present invention, when in the position shown in FIG. 1, is in the run-in condition, with lateral passages 58 isolated from the formation about to be penetrated for sampling of its fluid.

A second seal 13 and wiper 12 assembly is also provided in bottom sub 14 for contact with outer surface 56 of sample tube 15.

The details of the apparatus A of the present invention now having been described, its operation will be described in detail.

The apparatus A is lowered on a tubing string (not shown) adjacent the formation desired to be sampled. An auxiliary run of sample tubing is run in conjunction with the tubing string. The tubing string is connected at thread 20 and the auxiliary tubing is connected to boss 22 so that it is in fluid communication with passage 24. As the tubing string is lowered from the surface, the tapered ends 44 and 48 are embedded into the formation for a desired distance sufficient to isolate the sample to be obtained from well fluids. Having embedded the bottom sub 14 and portions of barrel 7 into the formation, additional weight is put on the tubing string which is transferred to mandrel 1, which in turn bears on shear nut 17. At a certain point depending upon the strength and number of shear screws 5, all of shear screws 5 shear and allow mandrel 1 to push sample tube 15 beyond bottom sub 14 which at that point is embedded in the formation. The mandrel 1 pushes sample tube 15 out further through bore 46 in bottom sub 14. Ultimately, lateral passages 58 are exposed. Having exposed lateral passages 58 in the formation at a depth sufficient to isolate them from well fluids, any formation fluids which migrate toward passages 58 will be collected within sample tube 15 and conducted through passages 28 and 24 up to the surface through the associated tubing connected to boss 22. While the sampling is taking place, spring 8 is bearing down on the connected assembly of barrel 7 and bottom sub 14 to ensure their continuing embedment in the formation as the fluid sample is being taken.

At the conclusion of the sampling, the valving at the surface on the auxiliary tubing connected to boss 22 is closed. The operator at the surface lifts up on the tubing string, which pulls up on mandrel 1. The upward pulling force on mandrel 1 pulls up sample tube 15 through bore 46 and back into the position shown in FIG. 1. Spring 8 assists in retracting sample tube 15 when the upward pull on mandrel 1 is exercised. Spring 8 also helps to retain the sample tube 15 in the position shown in FIG. 1 as the apparatus A is withdrawn from a wellbore. This prevents unwanted re-exposure of the passages 58 to the well fluids during the extraction step of the apparatus A.

Those skilled in the art will appreciate that sample tube point 16 may be made of a variety of materials to accommodate the specific application and may be sealingly mounted to sample tube 15 in a variety of ways to accommodate the well conditions anticipated.

If desired, a screening material may be employed in conjunction with passages 58 to further ensure the integrity of the openings against any particulate matter which may be tend to clog them. However, this is an optional feature which is not employed in the preferred embodiment.

The foregoing disclosure and description of the invention are illustrative and explanatory thereof, and various changes in the size, shape and materials, as well as in the details of the illustrated construction, may be made without departing from the spirit of the invention.

I claim:

1. A formation fluid sampling tool, comprising:

a housing;

a sample tube disposed for selective movement with respect to said housing from a retracted position where no sampling is taking place to an extended position for sampling;

retaining means on said sample tube, attaching said housing to said sample tube in said retracted position to selectively prevent relative longitudinal movement between said housing and said sample tube; wherein:

said retaining means allows said housing and sample tube in said retracted position to be simultaneously embedded into a formation to a sufficient depth to prevent well fluids from entering said sample tube; and wherein:

said sample tube is selectively actuated toward its extended position by release of said retaining means.

2. The apparatus of claim 1, further comprising:

at least one opening in said sample tube to admit a sample when said sample tube is in said extended position; and sealing means to isolate said opening from the formation when said sample tube is in said retracted position.

3. The apparatus of claim 2, further comprising biasing means for providing a force on said housing during sampling with said sample tube in said extended position.

4. The apparatus of claim 3, wherein said biasing means also applies a force on said sample tube to retain it toward said housing after sampling is concluded and movement of said sample tube towards said retracted position is initiated.

5. The apparatus of claim 3, further comprising:

a mandrel connected to said sample tube; wherein: said mandrel applies a force to said sample tube to simultaneously embed said sample tube and said housing into the formation until said force reaches a selected level allowing release of said retaining means.

6. The apparatus of claim 5, wherein said sample tube and said housing have a generally tapered leading end to facilitate their simultaneous embedment in the formation.

7. The apparatus of claim 6 wherein:

said housing has a bore extending through its tapered leading end;

said sample tube extends for slidable movement through said bore; and said sealing means seals on either side of said opening of said sample tube, when said sample tube is in said retracted position, to prevent entry of well fluids into said opening prior to extension of said sample tube.

8. The apparatus of claim 7, wherein:

said opening is disposed in said bore between said sealing means when said sample tube is in said retracted position;

said tapered end of said sample tube extends beyond said bore when said sample tube is in said retracted position; and said mandrel has a passage in flow communication with said opening in said sample tube to facilitate conduction of samples to the surface.

9. The apparatus of claim 8, wherein:

said retaining means is at least one shear pin and a shear ring;

said ring is retained to said sample tube;

said sample tube is retained to said mandrel; and an upward pull on said mandrel, after sampling, draws said sample tube into said housing until said shear ring is caught by said housing, stopping further movement by said sample tube relative to said housing, and defining the retracted position of said sample tube, which it retains as it is removed from the wellbore.

10. A method of sampling formation fluids, comprising the steps of:

lowering a tool having a housing and a sample tube securely mounted to said housing adjacent a formation to be sampled;

applying a force to simultaneously embed one end of said housing and one end of said sample tube into the formation;

sealing off said sample tube from the formation during embedment of said housing and said sample tube;

continuing application of said force to break said secure mounting of said sample tube to said housing;

continuing application of said force to extend said sample tube from said housing to allow sampling of fluid in a manner where well fluids are isolated from said sample tube;

retracting said sample tube toward said housing; and removing said tool.

* * * * *